US005243718A

United States Patent [19]

Shamie

[11] Patent Number: 5,243,718

[45] Date of Patent: Sep. 14, 1993

[54] FOLDABLE PLAYPEN

[76] Inventor: Louis Shamie, 972 Dean St., Brooklyn, N.Y.

[21] Appl. No.: 868,452

[22] Filed: Apr. 14, 1992

[51] Int. Cl.[5] ..... A47D 13/06

[52] U.S. Cl. ..... 5/99.1; 5/98.3

[58] Field of Search ..... 5/98.1, 99.1, 98.3

[56] References Cited

U.S. PATENT DOCUMENTS

| | | | |
|---|---|---|---|
| 2,486,054 | 10/1949 | Morse | 5/99.1 |
| 2,698,443 | 1/1955 | Ralick | 5/99.1 |
| 4,688,280 | 8/1987 | Kohus et al. | 5/99.1 |
| 4,703,525 | 11/1987 | Shamie | 5/99.1 |
| 4,811,437 | 3/1989 | Dillner et al. | 5/99.1 |
| 4,837,875 | 6/1989 | Shamie et al. | 5/99.1 |
| 4,934,025 | 6/1990 | Mariol | 5/99.1 X |

*Primary Examiner*—Michael F. Trettel
*Attorney, Agent, or Firm*—Burgess, Ryan & Wayne

[57] ABSTRACT

A foldable playpen comprises a frame including an upper frame assembly having a plurality of collapsible upper rails and a plurality of securing assemblies for releasably maintaining the upper rails in a non-collapsed position; a lower frame assembly including a central hub having a first hub section, a second hub section and a hinge assembly for hingedly connecting the first hub section to the second hub section for relative movement in a first plane, and four lower floor support rails having inner and outer ends, the inner end of each lower floor support rail being pivotally connected to the central hub for movement in a second plane substantially transverse to the first plane; four corner legs, each leg having an upper end and a lower end; and corner connecting devices for interconnecting the upper rails of the upper frame assembly to the upper ends of the corner legs and for interconnecting the outer ends of the lower floor support rails of the lower frame assembly to the lower ends of the corner legs; and a fabric enclosure surrounding a bottom and all sides of the frame.

17 Claims, 12 Drawing Sheets

FOLDABLE PLAYPEN

BACKGROUND OF THE INVENTION

The present invention relates generally to playpens, and more particularly, is directed to a playpen that can be folded into a small space for easy storage and transport.

Conventionally, playpens for infants have been rigid and heavy items that are assembled together in a fixed configuration. Recently, playpens that can be folded into a small space for easy storage and transport have been widely used. These foldable playpens are convenient items for use by mothers on the move.

One such playpen is disclosed in U.S. Pat. No. 4,703,525 to the same inventor herein and the entire disclosure of which is incorporated herein by reference, and provides four floor support members rotatably mounted in a horizontal plane in two socket members. The two socket members, in turn, are pivotally connected together for pivotal movement in the same horizontal plane. Therefore, the four floor support members can be moved to a position such that all four floor support members are parallel and adjacent to each other. However, this requires that some of the support members be disengaged, which is burdensome and can be difficult with the fabric material therearound. See also U.S. Pat. No. 4,837,875, also having the same inventor herein as part of the inventive entity thereof and the entire disclosure of which is also incorporated herein by reference, and which discloses a folding playpen that is similar in relevant respects to the aforementioned U.S. Pat. No. 4,703,525. Reference is also made to U.S. Design Patent No. 304,523, the entire disclosure of which is incorporated herein by reference.

U.S. Pat. No. 4,811,437 to Dillner et al, the entire disclosure of which is incorporated herein by reference, discloses a foldable playpen that includes a central hub member to which all of the floor support members are hingedly attached. Unlike the aforementioned U.S. Pat. No. 4,703,525 in which the floor support members are only pivotable in a horizontal plane, the floor support members are pivotally movable in a similar manner to the struts of an umbrella. In other words, all of the floor support members are pivotable from the horizontal plane in the open configuration of the playpen to a vertical position in the closed configuration of the playpen. In such position, the floor support members are vertically oriented in a parallel relation to each other. However, a larger central hub member is required, since the floor support members are pivotable only in the vertical direction in the aforementioned umbrella fashion.

OBJECTS AND SUMMARY OF THE INVENTION

Accordingly, it is an object of the present invention to provide a foldable playpen that overcomes the problems with the aforementioned prior art.

It is another object of the present invention to provide a foldable playpen that can be easily and readily converted between its closed and open configurations.

It is still another object of the present invention to provide a foldable playpen that can be folded without disassembling any parts.

It is yet another object of the present invention to provide a foldable playpen in which the entire folding operation can be performed without removing the fabric enclosure from the frame.

It is a further object of the present invention to provide a foldable playpen that is easy and economical to manufacture and use.

In accordance with an aspect of the present invention, a foldable playpen comprises a frame including an upper frame assembly having a plurality of collapsible upper rails and securing means for releasably maintaining the upper rails in a non-collapsed position; a lower frame assembly including a central hub having a first hub section, a second hub section and hinge means for hingedly connecting the first hub section to the second hub section for relative movement in a first plane, and a plurality of lower floor support rails having inner and outer ends, the inner end of each lower floor support rail being pivotally connected to the central hub for movement in a second plane substantially transverse to the first plane; a plurality of corner legs, each leg having an upper end and a lower end; and connecting means for interconnecting the upper rails of the upper frame assembly to the upper ends of the corner legs and for interconnecting the outer ends of the lower floor support rails of the lower frame assembly to the lower ends of the corner legs; and a fabric enclosure surrounding a bottom and all sides of the frame.

The four upper rails each include a first rail section and a second rail section, and the securing means includes a plurality of securing elements, each securing element pivotally connecting adjacent ends of the rail sections of the same upper rail. Each securing element includes a medial saddle member formed by two substantially rectangular plates and a central, inverted U-shaped connector which connects the upper edges of the plates together so as to maintain the plates in a parallel, spaced apart relation, with the adjacent ends of the rail sections being pivotally connected between opposite ends of the plates. The length of the U-shaped connector is less than the lengths of the plates such that the plates permit upward pivotal movement of the rail sections relative to the plates.

One of the plates of each medial saddle member includes a pair of holes therein, and the adjacent ends of the rail sections each include a hole therein, a button extending through the hole therein and a spring for biasing the button through the hole therein, such that engagement of each button through one hole in the medial saddle member results in releasable locking of the rail sections in the non-collapsed position.

Each securing means includes a release slide for releasing the buttons from the pair of holes in the medial saddle member. The release slide slides along the medial saddle member, and includes two projections for pushing the buttons out of the holes in the medial saddle member when the release slide is slid along the medial saddle member. A spring is provided for normally biasing the release slide such that the projections are positioned out of engagement with the buttons. The release slide also has a lower surface provided with two hemispherical recesses which are normally aligned with the pair of holes of the medial saddle member to receive the buttons therein and not interfere with the locking engagement by the buttons.

The first hub section and the second hub section are hingedly connected for relative movement in a vertically oriented plane, and the inner end of each lower floor support rail is pivotally connected to the central hub for movement in a horizontally oriented plane.

Further, there are four lower floor support rails, two of the lower floor support rails being pivotally connected with the first hub section and the remaining two of the lower floor support rails being pivotally connected with the second hub section. The outer ends of the lower floor support rails are pivotally connected to the connecting means.

The central hub includes limiting means for limiting pivotal movement of the lower floor support rails to a predetermined arc. The limiting means includes a plurality of arcuate recesses in the first and second hub sections of the central hub, and a pin extending through the inner end of each lower floor support rail and positioned within one recess.

First and second auxiliary floor support legs are also connected with the central hub for additionally supporting the playpen on a surface.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
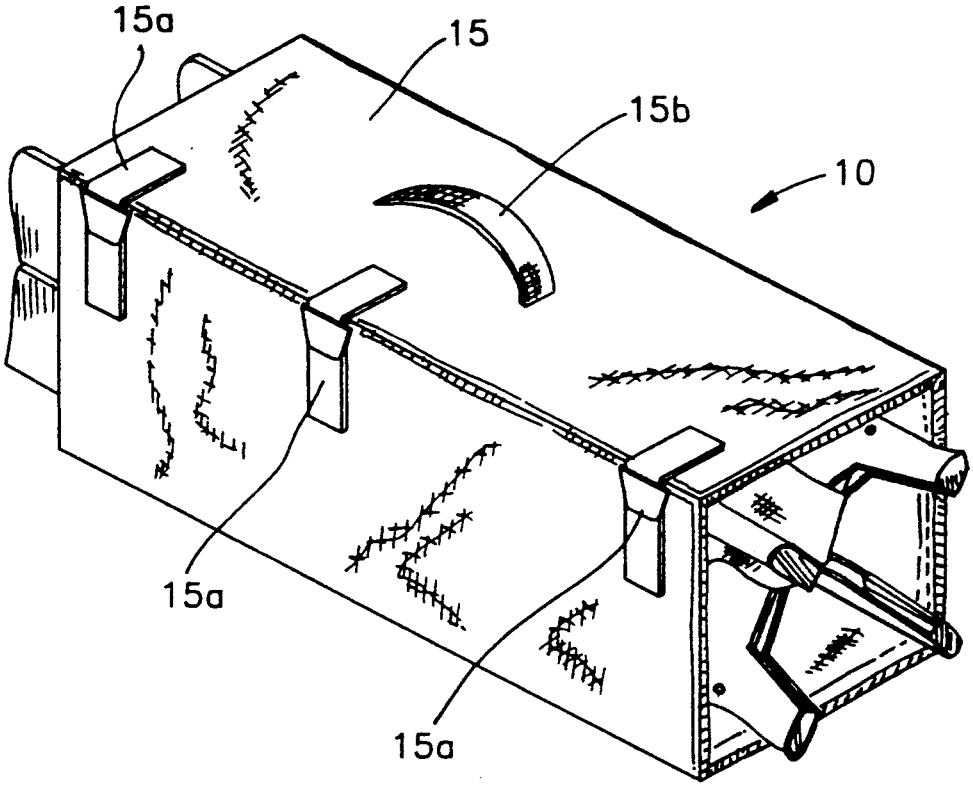
FIG. 1 is a perspective view of a foldable playpen in its stored configuration.

Referring to the drawings in detail, and initially to FIGS. 2–4, a foldable playpen 10 according to the present invention includes a frame 12 and a fabric enclosure 14 secured to frame 12 in a manner to be described hereinafter. Frame 12 basically includes an upper frame assembly 16, a lower frame assembly 18 and a plurality of corner legs 20 which maintain upper frame assembly 16 and lower frame assembly 18 in a horizontally oriented, parallel, spaced apart relation in the open configuration of playpen 10, as shown in FIG. 4.

Figure 4:
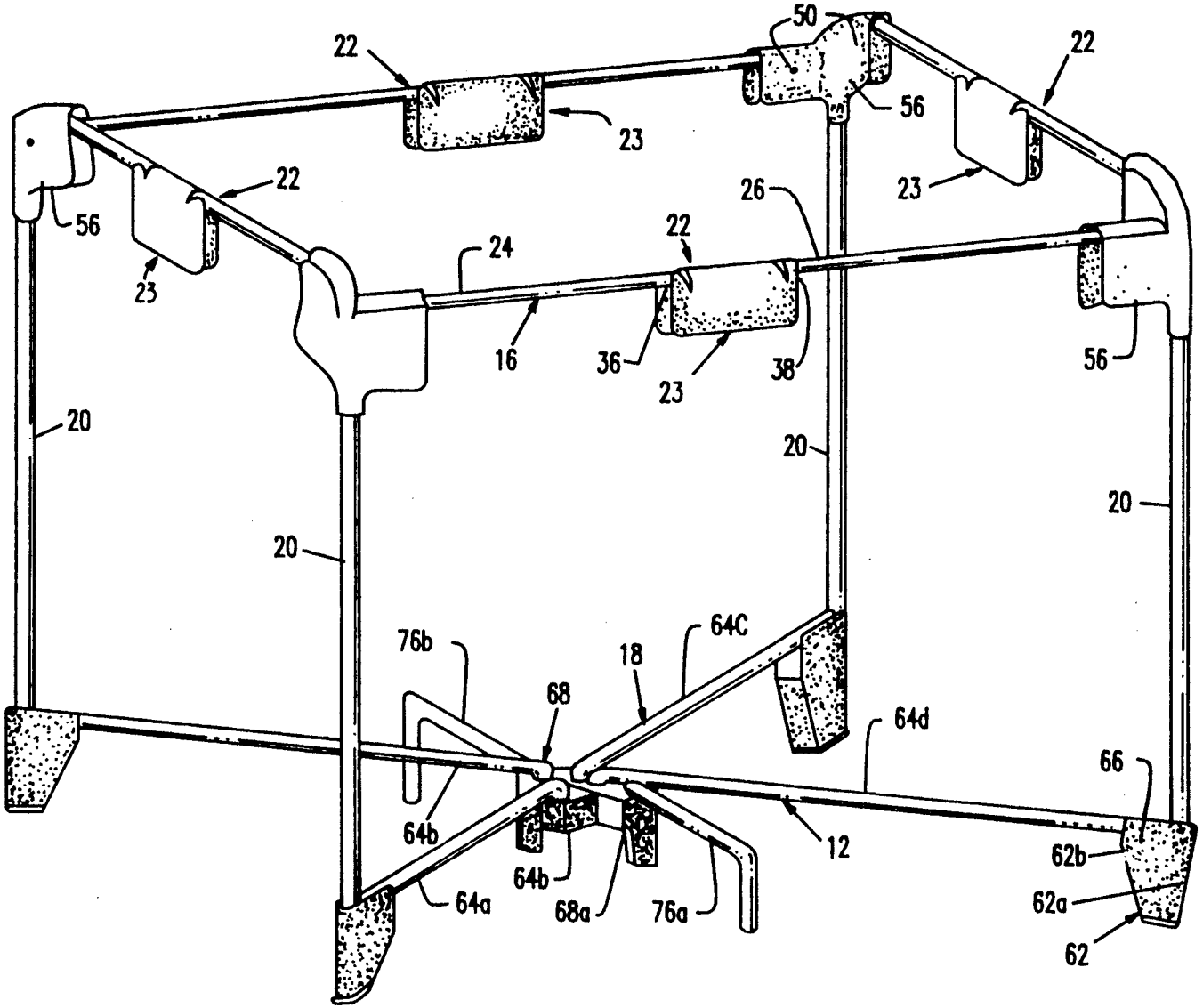
FIG. 4 is a perspective view of the frame of the foldable playpen of FIG. 1 in its fully opened configuration.

Upper frame assembly 16 includes a plurality of collapsible upper rails 22 and securing means 23 for releasably maintaining upper rails 22 in the non-collapsed position of FIG. 4. Specifically, there are four upper rails 22, each formed by a first rail section 24 and a second rail section 26. The adjacent ends of rail sections 24 and 26 of each upper rail 22 are pivotally connected with one securing means 23.

As shown best in FIGS. 16–24, each securing means 23 includes a medial saddle member 28 formed by two substantially rectangular plates 30 and 32 of identical dimensions and a central, inverted U-shaped connector 34 which connects the upper edges of plates 30 and 32 together so as to maintain plates 30 and 32 in a parallel, spaced apart relation. Plate 30 constitutes an inner plate while plate 32 constitutes an outer plate. The length of U-shaped connector 34 is less than the lengths of plates 30 and 32 such that plates 30 and 32 have side portions **30*a*, 30*b* and 32*a*, 32*b*, respectively, that extend outwardly past opposite ends of U-shaped connector 34**.

Side portions **30*a* and 32*a* are provided with holes 30*c* and 32*c*, respectively, which are in alignment with each other, and side portions 30*b* and 32*b* are provided with holes 30*d* and 32*d*, respectively, which are in alignment with each other. Rail section 24 has one end thereof positioned between the upper ends of side portions 30*a* and 32*a* and within approximately one-half of U-shaped connector 34. A pivot pin 36 (FIGS. 4 and 5) is positioned through holes 30*c* and 32*c* of side portions 30*a* and 30*b*, and through a corresponding hole 24*a* (FIG. 23) in rail section 24 in order to pivotally connect rail section 24 to medial saddle member 28. In like manner, rail section 26 has one end thereof positioned between the upper ends of side portions 30*b* and 32*b* and within approximately one-half of U-shaped connector 34. A pivot pin 38 (FIGS. 4 and 5) is positioned through holes 30*d* and 32*d* of side portions 30*b* and 32*b*, and through a corresponding hole 26*a* (FIG. 23) in rail section 26 in order to pivotally connect rail section 26 to the opposite side of medial saddle member 28. Because rail sections 24 and 26 are disposed in U-shaped connector 34, rail sections 24 and 26 can only pivot between the position shown in FIG. 4 to the position shown in FIG. 6**.

In order to releasably lock each rail section 24 and 26 within U-shaped connector 34, plate 32 is formed with two additional holes 32*e* and 32*f* which are spaced apart and are positioned on an imaginary line connecting holes 32*c* and 32*d*. Each hole 32*e* and 32*f* has an elongated recess 32*g* and 32*h*, respectively, on the same imaginary line and which leads into the respective hole 32*e* and 32*f*.

Figure 24:
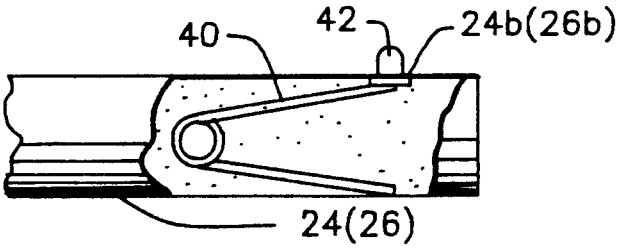
FIG. 24 is bottom plan view, partially broken away, or the cross bar of FIG. 23.
Figure 15:
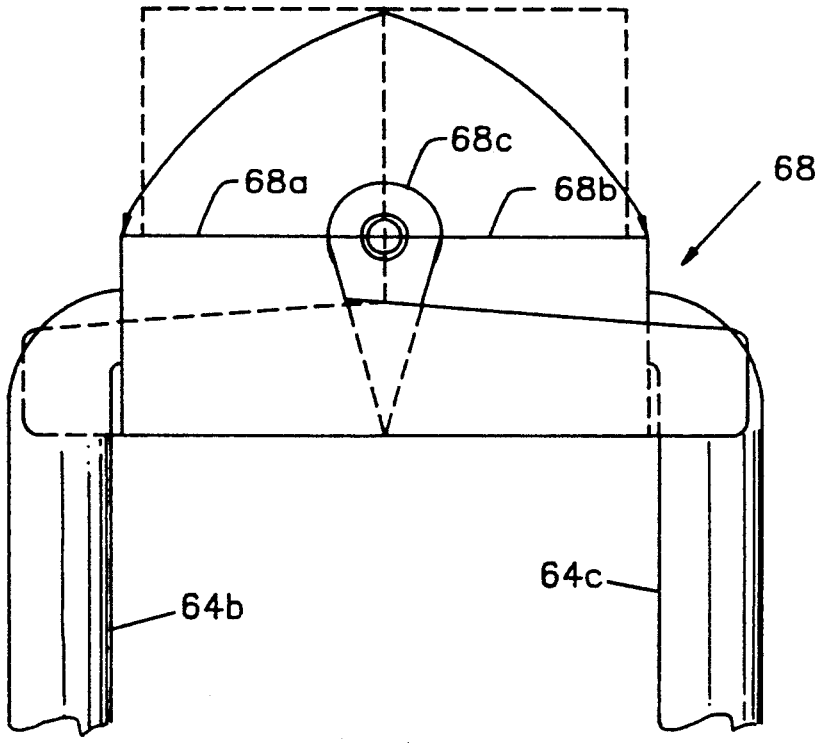
FIG. 15 is a side elevational view showing the hinge assembly in its folded configuration.
Figure 16:
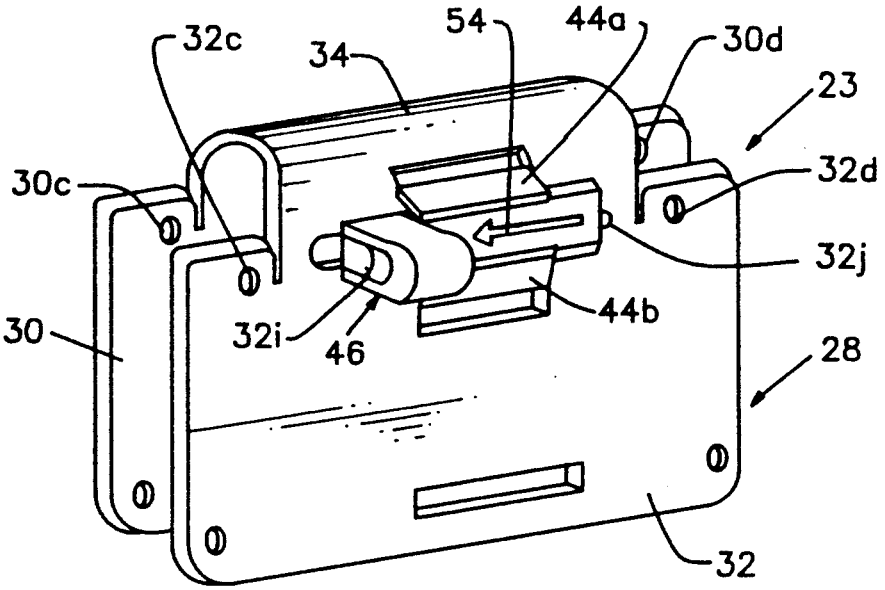
FIG. 16 is a perspective view of a latch assembly for latching the upper connecting bars.
Figure 17:
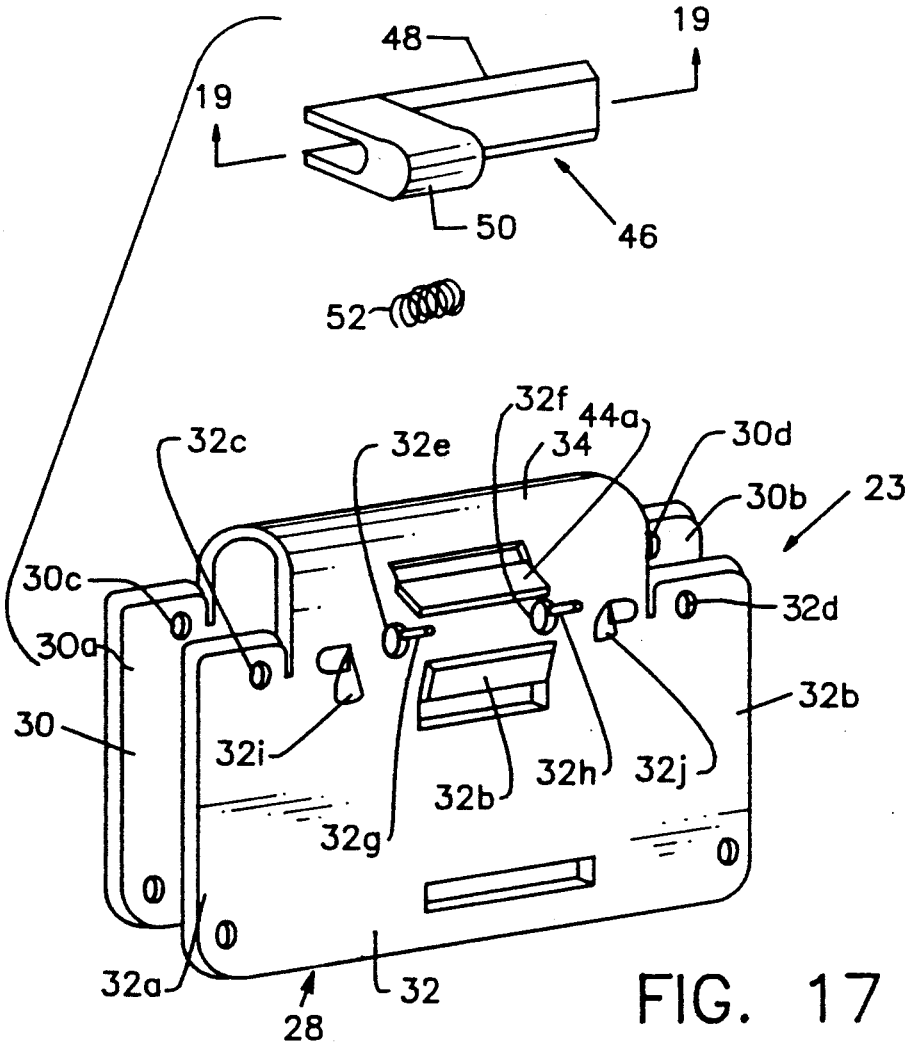
FIG. 17 is an exploded perspective view of the latch assembly of FIG. 16.
Figure 18:
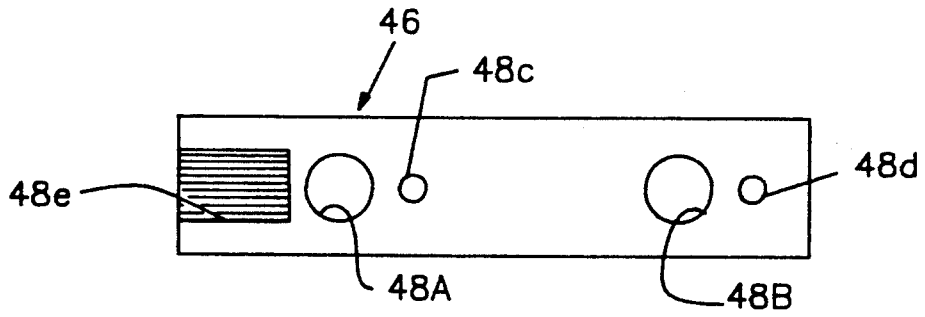
FIG. 18 is bottom plan view of the release slide of the latch assembly.
Figure 19:
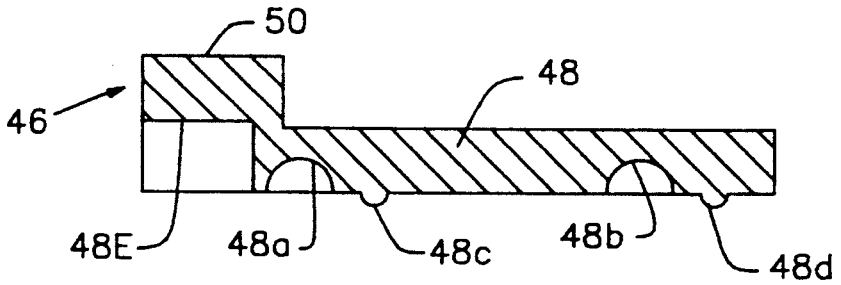
FIG. 19 is cross-sectional view of the release slide of FIG. 18, taken along line 19—19 thereof.
Figure 20:
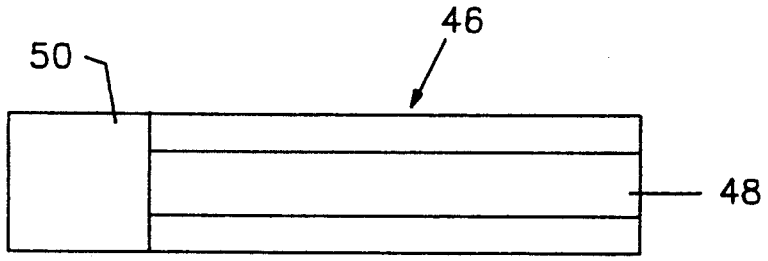
FIG. 20 is top plan view of the release slide of FIG. 18.
Figure 21:
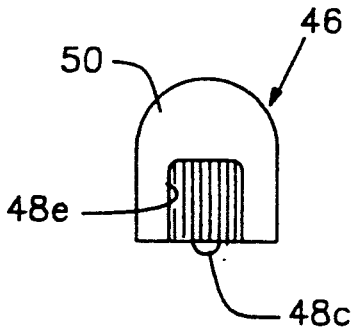
FIG. 21 is an end plan view of the release slide of FIG. 18.
Figure 22:
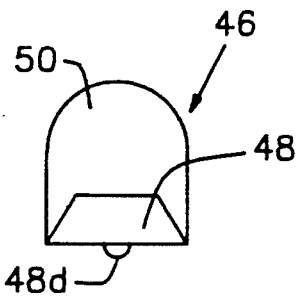
FIG. 22 is an opposite end plan view of the release slide of FIG. 18.

With this arrangement, as shown in FIG. 24, each rail 24 and 26 has a hole 24*b* and 26*b* therein which is in axial alignment with holes 24*a* and 26*a*, respectively. A conventional spring 40 is positioned with each rail 24 and 26. Each spring 40 has a button 42 attached to one end thereof that fits through and is biased in the hole 24*b* or 26*b*. Thus, when the ends of rails 24 and 26 are positioned within U-shaped connector 34, buttons 42 therein engage within holes 32*e* and 32*f*, respectively, to lock rails 24 and 26 therein in axial alignment with each other. In other words, rails 24 and 26 effectively form a single rail in such position, as shown in FIG. 4.

In order to release rails 24 and 26 from such position, an upper rectangular push-out section 44*a* is provided above the aforementioned imaginary line and between holes 32*e* and 32*f*. Rectangular push-out section 44*a* extends outwardly and downwardly at an angle from plate 32. A lower rectangular push-out section 44*b* is provided below the aforementioned imaginary line and between holes 32*e* and 32*f*. Rectangular push-out section 44*b* extends outwardly and upwardly at an angle from plate 32.

A release slide 46, as best shown in FIGS. 17–22, is restrained by and slidably movable between push-out sections 44*a* and 44*b*. As shown, release slide 46 has a generally rectangular base section 48 and a raised pusher section 50 formed at one end on the upper surface of base section 48, by which a user can slide release slide 46 back and forth between push-out sections 44*a* and 44*b*. The lower surface of base section 48 is formed with two axially spaced hemispherical recesses 48*a* and 48*b* which can be aligned with holes 32*e* and 32*f* of plate 32. In this position, release slide 46 does not interfere with the locking arrangement of rails 24 and 26.

In addition, two smaller diameter hemispherical projections 48*c* and 48*d* are formed on the lower surface of base section 48 adjacent recesses 48*a* and 48*b*, respectively. Projections 48*c* and 48*d* are adapted to fit and slide within elongated recesses 32*g* and 32*h*. In order to release the aforementioned locking arrangement of buttons 42 within holes 32, release slide 46 is slid in a direction such that projections 48*c* and 48*d* are positioned over holes 32*e* and 32*f*. As a result, buttons 42 are forced out of holes 32*e* and 32*f*, whereby rails 24 and 26 can be pivoted to the positions of FIGS. 5 and 6, about pivot pins 36 and 38.

Release slide 46 is normally maintained with axially spaced hemispherical recesses 48*a* and 48*b* out of alignment with holes 32*e* and 32*f* of plate 32, in order to maintain the locked arrangement of rails 24 and 26. In order to normally maintain release slide 46 in this position, a rectangular recess 48*e* is formed in base section 48 below pusher section 50. Further, push-out tabs 32*i* and 32*j* extend outwardly from plate 32 along the aforementioned imaginary line and are positioned between holes 32*c*, 32*e* and 32*d*, 32*f*, respectively. The spacing between tabs 32*i* and 32*j* is such as to permit sliding movement of release slide 46 between a position in which projections 48*c* and 48*d* are in alignment with holes 32*e* and 32*f*, and a position in which projections 48*c* and 48*d* are positioned at the opposite extreme ends of recesses 32*g* and 32*h*. As such, tabs 32*i* and 32*j* prevent escape of release slide 46. Further, a coil spring 52 is positioned in recess 48*e* such that coil spring 52 is compressed between the end of base section 48 and tab 32*i*. As a result, coil spring 52 biases release slide 46 to the right of FIG. 16, in a direction opposite to arrow 54 shown therein. In such position, projections 48*c* and 48*d* are positioned at the opposite extreme ends of recesses 32*g* and 32*h*, and out of alignment with holes 32*e* and 32*f* of plate 32, in order to maintain the locked arrangement of rails 24 and 26. To release rails 24 and 26, the user merely pushes pusher section 50 in the direction of arrow 54.

Figure 26:
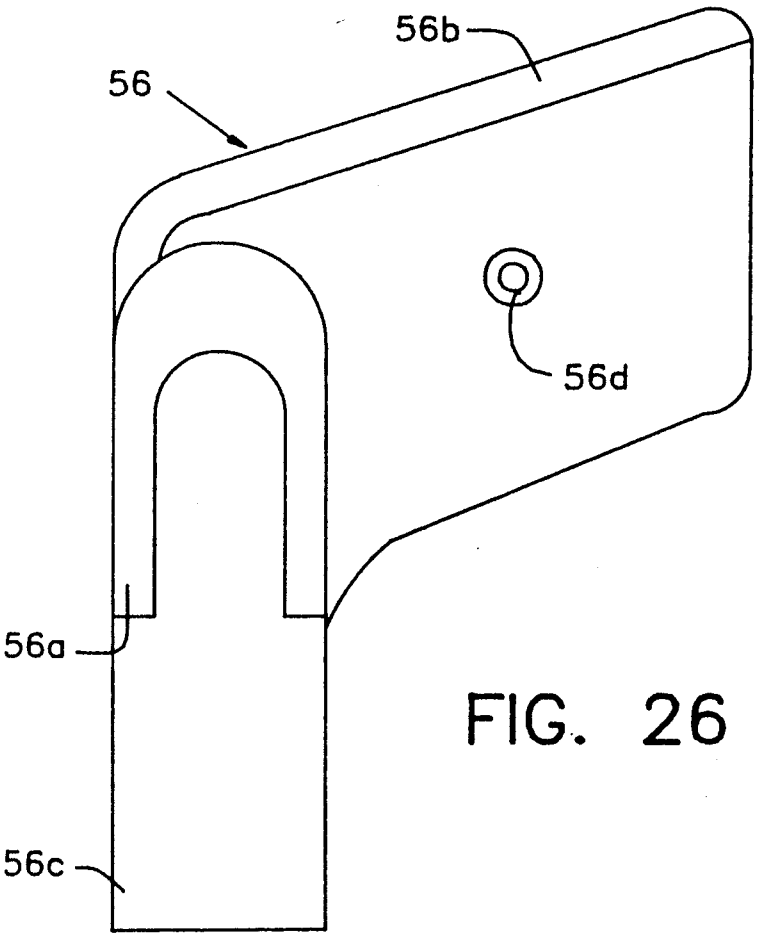
FIG. 26 is an elevational view of the upper corner connector element of FIG. 25, viewed at a 90° angle from the view of FIG. 25.
Figure 25:
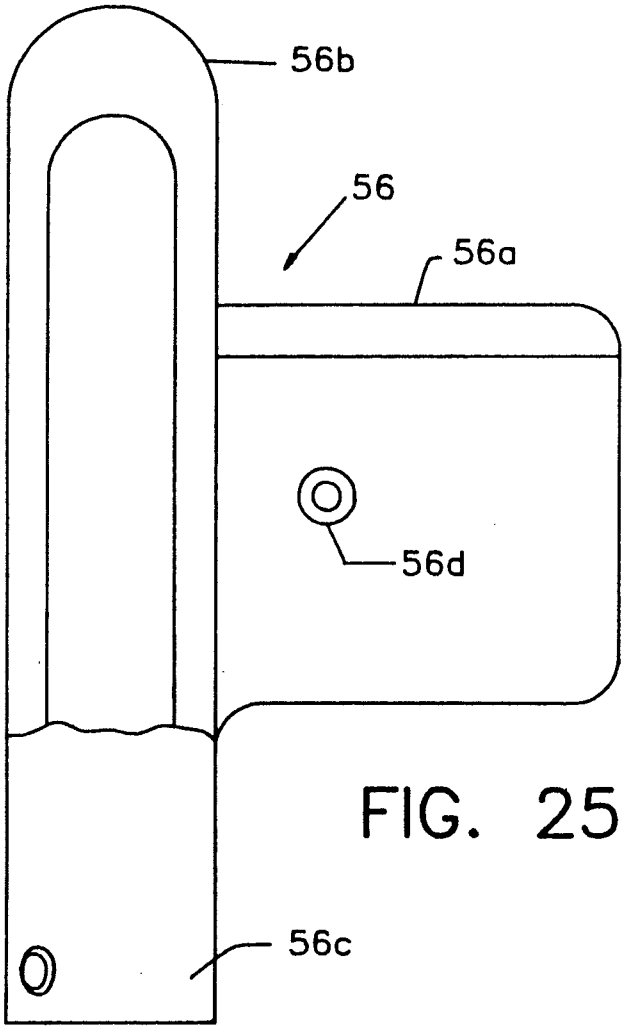
FIG. 25 is an elevational view of one upper corner connector element.

The opposite free ends of rails 24 and 26 are pivotally connected to upper corner connector elements 56, shown best in FIGS. 25 and 26. Specifically, each connector element 56 includes a first inverted U-shaped section 56*a* extending in a first direction, a second inverted U-shaped section 56*b* connected with the first inverted U-shaped section 56*a* and extending in a second direction substantially transverse to the first direction, and a third tubular section 56*c* connected with first and second inverted U-shaped sections 56*a* and 56*b* and extending downwardly in a third direction substantially transverse to the first and second directions. The opposite ends of rails 24 and 26 fit within inverted U-shaped sections 56*a* and 56*b* at the upper corners of playpen 10. The opposing walls of inverted U-shaped sections 56*a* and 56*b* have aligned holes 56*d* therein. Thus, the opposite ends of rails 24 and 26 are pivotally connected within inverted U-shaped sections 56*a* and 56*b* by pivot pins 58 extending therethrough, for movement between the positions shown in FIGS. 4 and 6.

Figure 5:
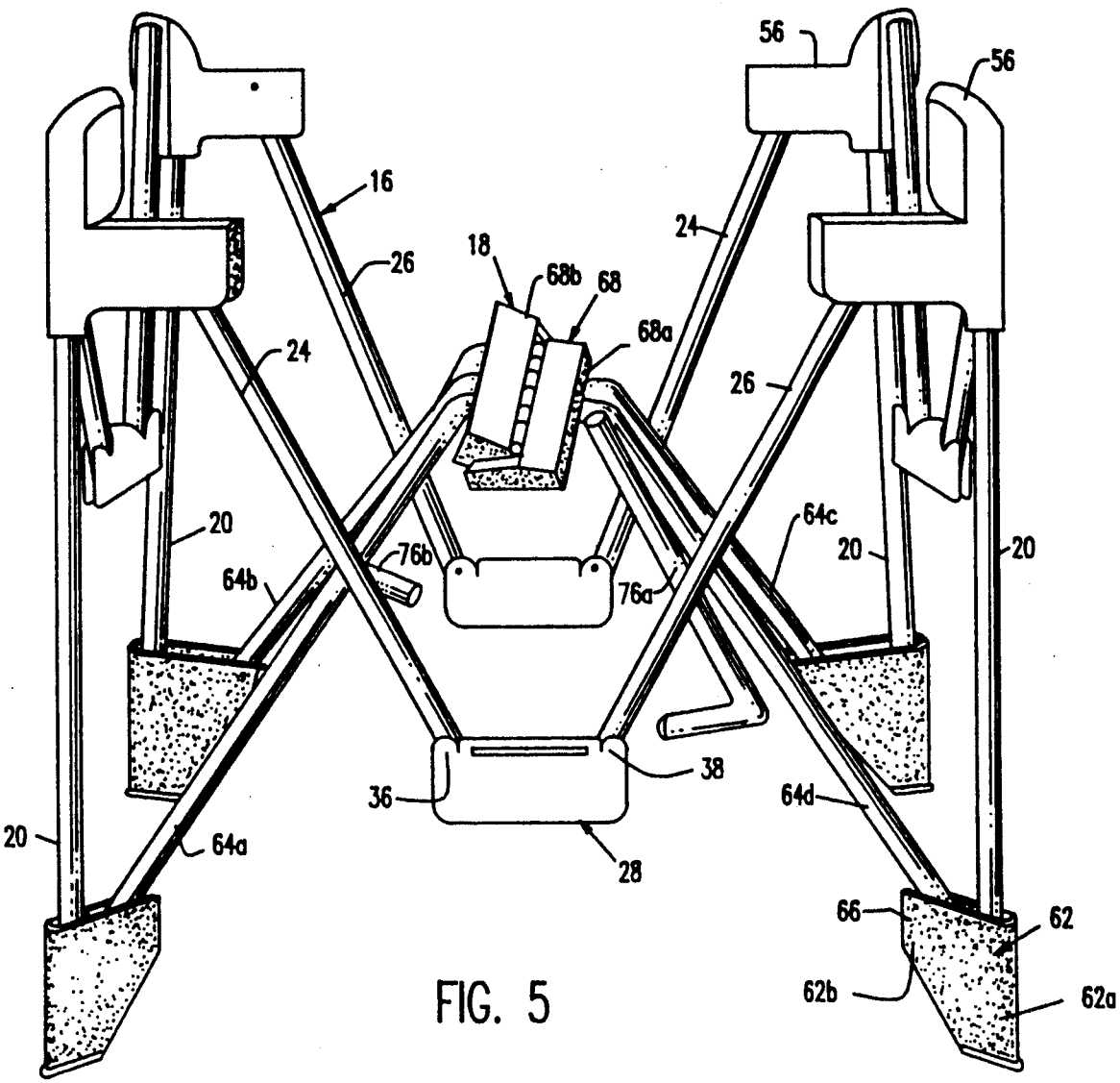
FIG. 5 is a perspective view of the frame of FIG. 3 in its partially closed configuration.

Four vertically oriented corner legs 20 are provided, with the upper end of each leg 20 being fit within the third tubular section 56*c* of one connector element 56. The lower end of each leg 20 is fit within a first tubular section 62*a* of a lower corner connector element 62, which also contains a second U-shaped section 62*b*, as best shown in FIG. 5. Each U-shaped section 62*b* opens in a direction into the center of playpen 10.

A lower frame 18 is provided with four lower floor support rails 64*a*–64*d*, each rail 64*a*–64*d* having an outer end pivotally connected within a respective U-shaped section 62*b* by a pivot pin 66. Accordingly, rails 64*a*–64*d* extend inwardly toward the center of playpen 10 along a horizontal plane.

Figure 6:
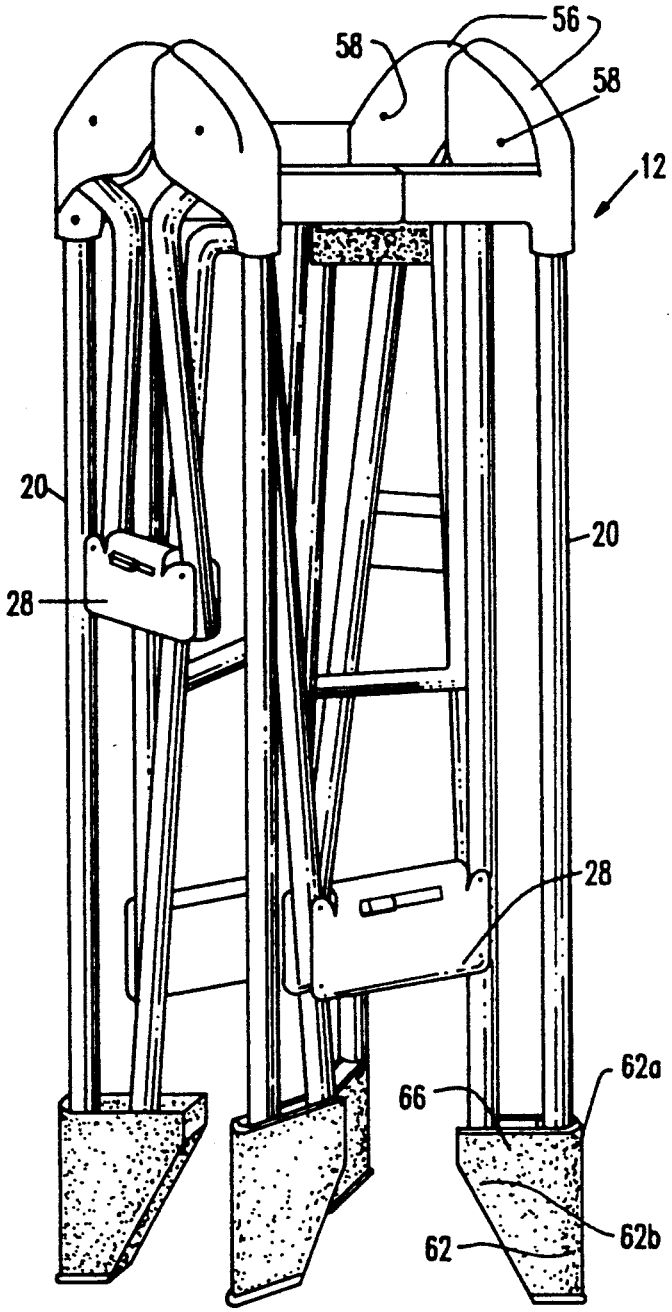
FIG. 6 is a perspective view of the frame of FIG. 3 in its fully closed configuration.
Figure 7:
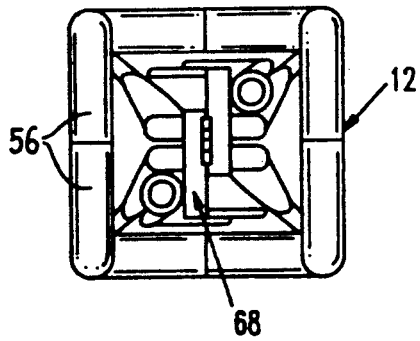
FIG. 7 is top plan view of the frame of FIG. 6.
Figure 8:
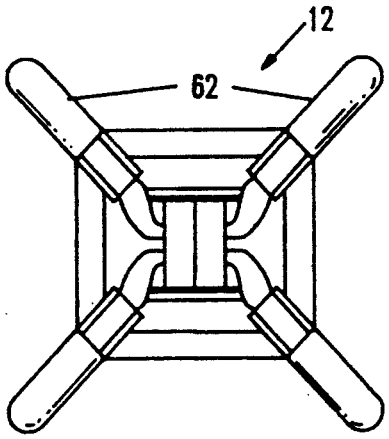
FIG. 8 is bottom plan view of the frame of FIG. 6.
Figure 9:
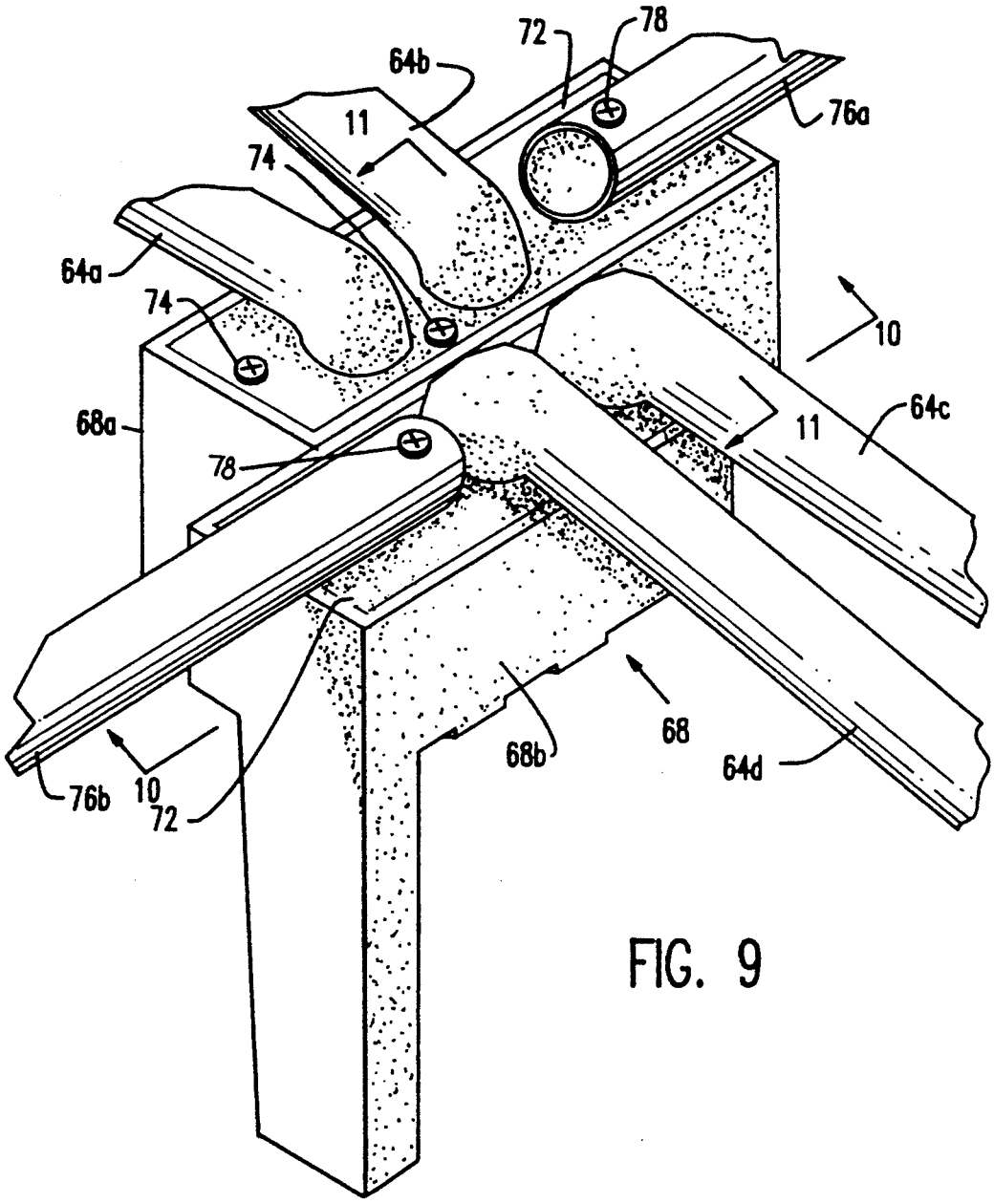
FIG. 9 is a perspective view of the hinge assembly of the frame of FIG. 4.
Figure 10:
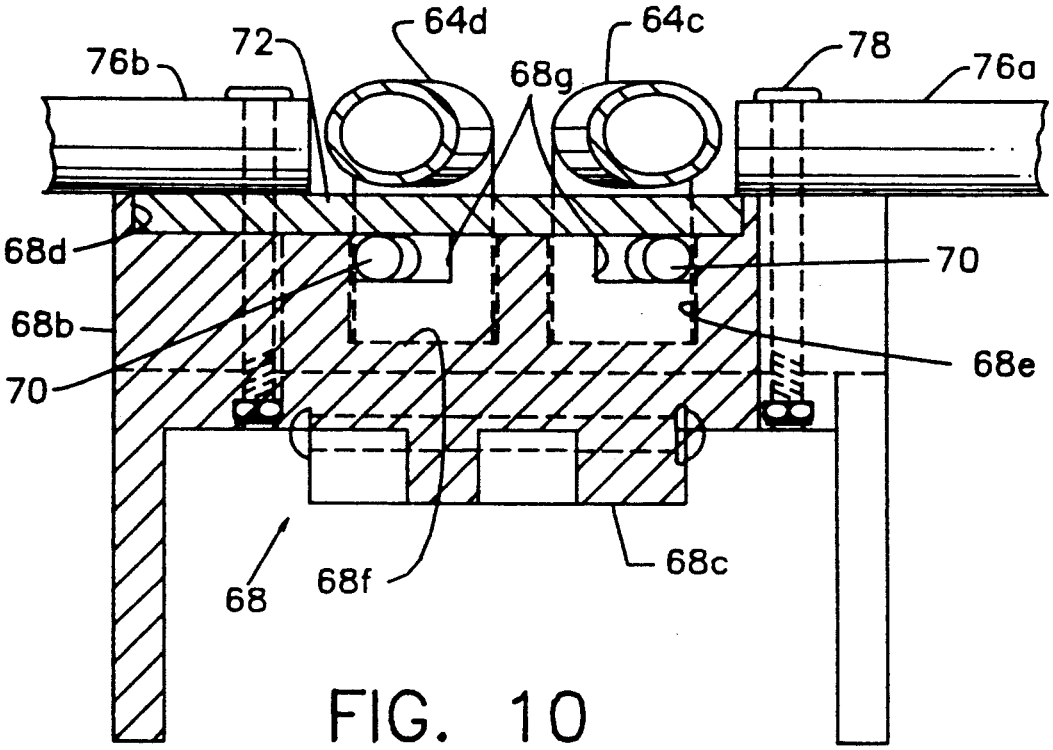
FIG. 10 is a cross-sectional view of the hinge assembly of FIG. 9, taken along line 10—10 thereof.
Figure 11:
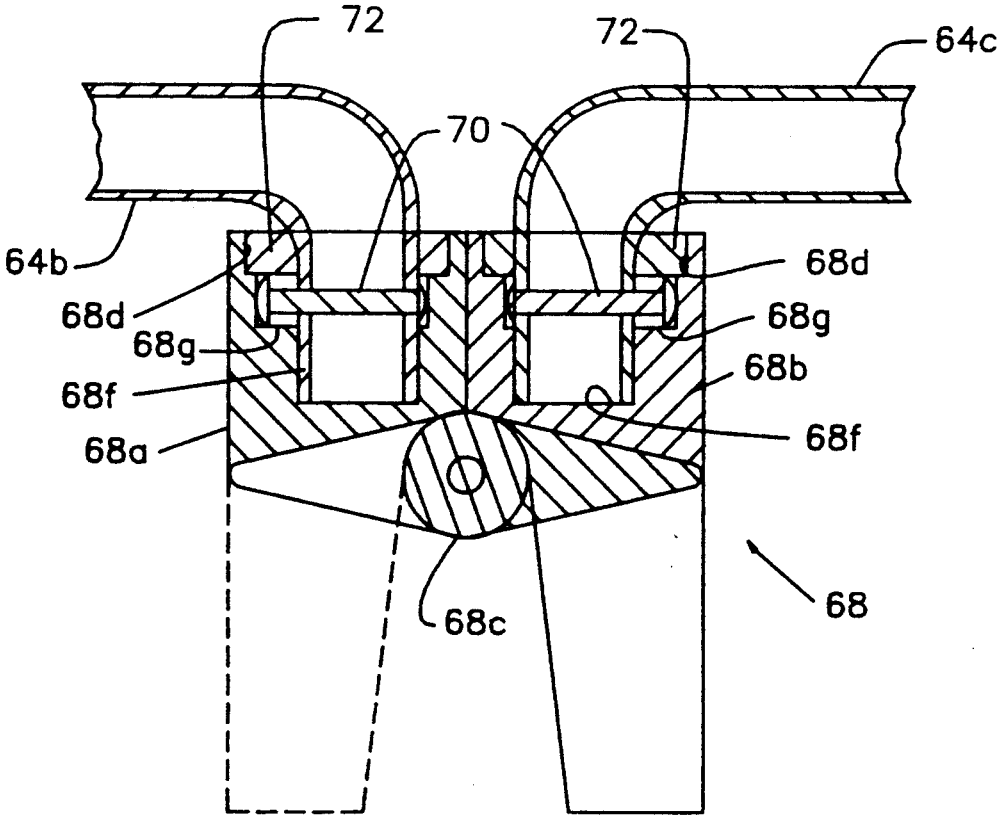
FIG. 11 is a cross-sectional view of the hinge assembly of FIG. 9, taken along line 11—11 thereof.
Figure 12:
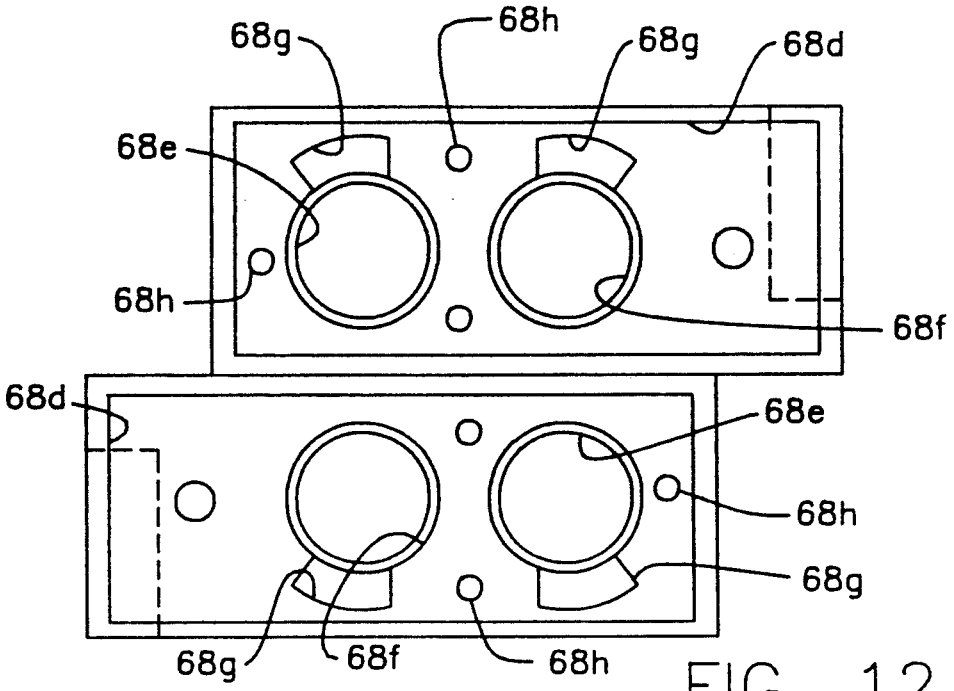
FIG. 12 is a top plan view of the hinge assembly of FIG. 9, with the connecting rods and cover plate removed.
Figure 13:
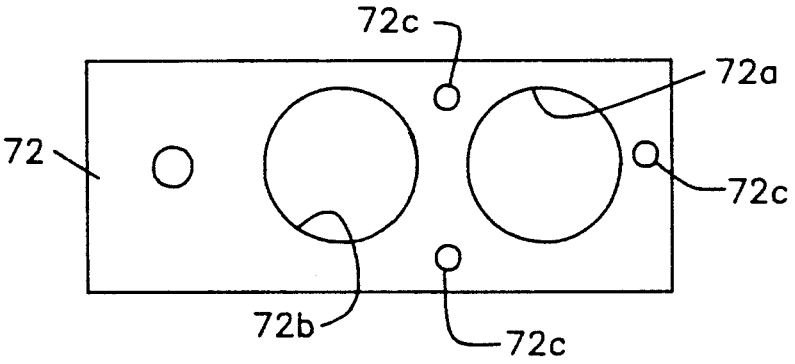
FIG. 13 is top plan view of the cover plate of the hinge assembly of FIG. 9.
Figure 14:
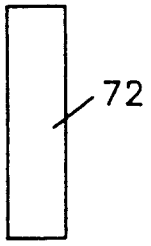
FIG. 14 is an end plan view of the cover plate of FIG. 13.
Figure 23:
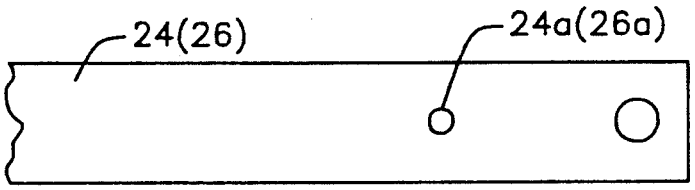
FIG. 23 is a side elevational view of a cross bar containing the button which engages with the latch assembly of FIG. 16.

Lower frame 18 further includes a central hub 68 to which the inner ends of rails 64*a*–64*d* are connected. Specifically, central hub 68 includes a first hub section 68*a*, a second hub section 68*b* and a hinge assembly 68*c* for hingedly connecting first hub section 68*a* to second hub section 68*b* for relative movement in a vertical plane, as shown in FIGS. 4–6. As shown best in FIGS. 9–14, first and second hub sections 68*a* and 68*b* each include an enlarged rectangular recess 68*d* at the upper end thereof. Two circular holes 68*e* and 68*f* are formed in recess 68*d* and extend to a greater depth than recess 68*d*, for receiving the bent inner ends of rails 64*a*–64*d*, with rails 64*a* and 64*b* being positioned in circular holes 68*e* and 68*f* of first hub section 68*a* and rails 64*c* and 64*d* being positioned in circular holes 68*e* and 68*f* of second hub section 68*b*. In this manner, the bent inner ends of rails 64*a*–64*d* are pivotally movable in holes 68*e* and 68*f*, in a horizontal plane, that is, in a plane transverse to the movement of first hub section 68*a* with respect to second hub section 68*b*.

In order to limit such pivotal movement of rails 64*a*–64*d*, a restraining pin 70 is inserted in the bent inner end of each rail 64a–64d that is seated within the respective circular hole 68e or 68f. A wedge-shaped recess 68g is provided in recess 68d and forms a lateral extension of the upper end of each circular hole 68e and 68f, thereby limiting pivotal movement of each rail 64a–64d to the angle determined by the opposite ends of recess 64g.

In order to prevent escape of the bent inner ends of rails 64a–64d from holes 68e and 68f, a cover plate 72 fits within each recess 68d in covering relation to restraining pins 70. In this regard, each cover plate 72 includes two circular holes 72a and 72b which are in alignment with circular holes 68e and 68f to permit entry and pivotal movement of the bent inner ends of rails 64a–64d.

Cover plate 72 also contains three screw openings 72c which are in alignment with three threaded openings 68h in recess 68d. Accordingly, screws 74 are provided to threadedly secure cover plates 72 to first and second hub sections 68a and 68b.

In addition, auxiliary lower floor support legs 76a and 76b are provided, each fixedly secured to hub sections 68a and 68b, respectively, by bolts 78, such that auxiliary lower floor support legs 76a and 76b extend in a horizontal plane in the open configuration of playpen 10, as shown in FIG. 4. Auxiliary lower floor support legs 76a and 76b generally bisect the angle between rails 64a and 64c, and between rails 64b and 64d, respectively. Further, lower floor support legs 76a and 76b have downturned or bent free ends that rest upon a surface to provide support for playpen 10 When the latter is opened to the position shown in FIG. 4.

In order to close frame 12 from the position shown in FIG. 4 to the position shown in FIG. 6, all release slides 46 are moved in the direction of arrow 54, and the corresponding rails 24 and 26 are pivoted to the position shown in FIG. 5. In such movement, lower floor support rails 64a and 64b pivot toward each other within circular holes 68e and 68f, and lower floor support rails 64c and 64d pivot toward each other within circular holes 68e and 68f. Then, hub sections 68a and 68b are pivoted about hinge assembly 68c, also to the position shown in FIG. 5. Thereafter, with continued pivoted movement of the various elements, as is obvious from FIG. 5, frame 12 is closed to the position of FIG. 6. To open frame 12, the reverse operation is performed.

As discussed above, a fabric enclosure 14 is provided around frame 12, and does not hinder the aforementioned opening and closing of frame 12. Fabric enclosure 14 includes four side panels 14a–14d, each side panel being connected between adjacent vertically oriented corner legs 60 and with a collapsible upper rail 22. In addition, a bottom panel 14e is connected to the lower edges of side panels 14a–14d and is positioned above lower floor support rails 64a–64d so as to be supported thereby. Further, each auxiliary lower floor support leg 76a and 76b is fastened to the underside of bottom panel 14e by a fabric tab 14f.

Figure 2:
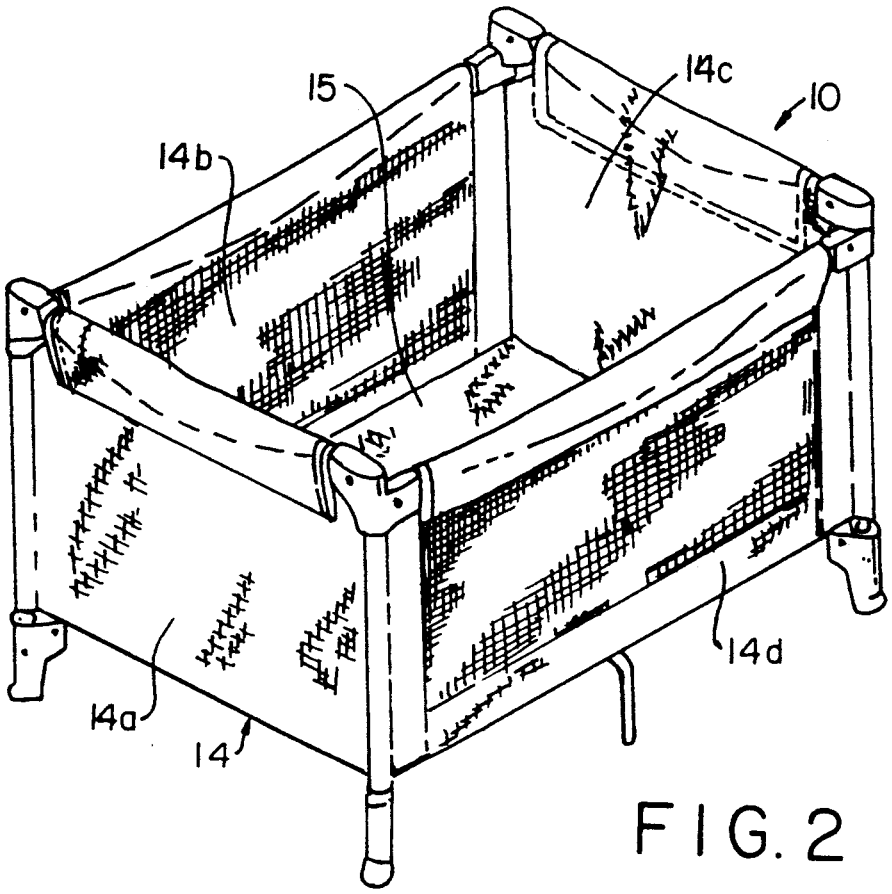
FIG. 2 is top perspective view of a foldable playpen according to the present invention.
Figure 3:
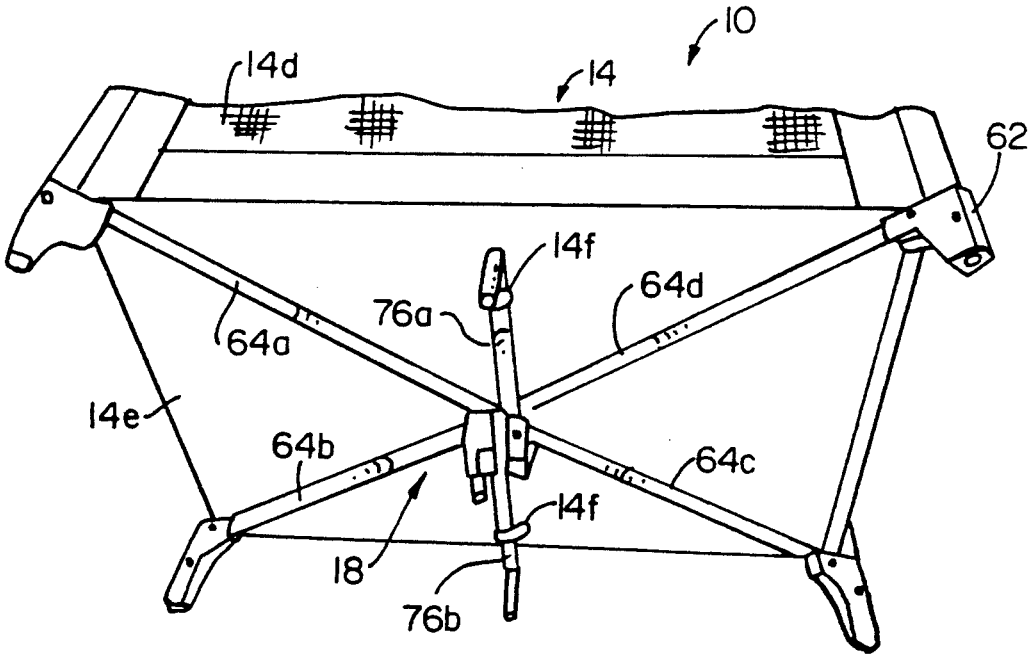
FIG. 3 is bottom perspective view of the foldable playpen of FIG. 1.

In addition, a substantially rectangular foldable floor mat 15 is provided for insertion on top of bottom panel 14e in the open configuration of playpen 10, as shown in FIG. 2. Floor mat 15 includes "VELCRO" securing tabs 15a for securing floor mat 15 about the closed playpen 10, as shown in FIG. 1, and further includes a handle 15b for carrying the stored playpen 10, in the same manner as shown and described in U.S. Pat. No. 4,811,437 and U.S. Design Pat. No. 304,523.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

I claim:

1. A foldable playpen comprising:

a) a frame including:

i) an upper frame assembly having a plurality of collapsible upper rails and securing means for releasable maintaining said upper rails in a non-collapsed position, each said upper rail including a first rail section and a second rail section, and said securing means including a plurality of securing elements, each securing element pivotally connecting adjacent ends of the rail sections of the same upper rail, and each said securing element including a medical saddle member formed by two substantially rectangular plates and a central inverted u-shaped connector which connects the upper edges of said plates together so as to maintain said plates in a parallel, spaced apart relation, with said adjacent ends of said rail sections being pivotally connected at opposite ends of said plates, one of said plates of each said medial saddle member including a pair of holes therein, and the adjacent ends of said rail sections each including a hole therein, a button extending through the hole therein and spring biasing means for biasing the button through the hole therein, such that engagement of each said button through one of said pair of holes in said medial saddle member results in releasable locking of said rail sections in said non-collapsed position, ii) a lower frame assembly including:

A) a central hub having a first hub section, a second hub section and hinge means for hingedly connecting said first hub section to said second hub section for relative movement in a first plane, and B) a plurality of lower floor support rails having inner and outer ends, the inner end of each said lower floor support rail being pivotally connected to said central hub for movement in a second plane substantially transverse to said first plane;

iii) a plurality of corner legs, each leg having an upper end and a lower end, iv) connecting means for interconnecting said upper rails of said upper frame assembly to the upper ends of said corner legs and for interconnecting the outer ends of said lower floor support rails to the lower ends of said corner legs; and b) a fabric enclosure surrounding a bottom and all sides of said frame.

2. A foldable playpen according to claim 1, wherein said first hub section and said second hub section are hingedly connected for relative movement in a vertically oriented plane, and the inner end of each said lower floor support rail is pivotally connected to said central hub for movement in a horizontally oriented plane.

3. A foldable playpen according to claim 2, wherein there are four lower floor support rails, two of said lower floor support rails being pivotally connected with said first hub section and the remaining two of said lower floor support rails being pivotally connected with said second hub section.

4. A foldable playpen according to claim 3, wherein the outer ends of said lower floor support rails are pivotally connected to said connecting means.

5. A foldable playpen according to claim 1, wherein said central hub includes limiting means for limiting pivotal movement of said lower floor support rails to a predetermined arc.

6. A foldable playpen according to claim 5, wherein said limiting means includes a plurality of arcuate recesses in said first and second hub sections of said central hub, and pin means extending through the inner end of each said lower floor support rail and positioned within one said recesses.

7. A foldable playpen according to claim 1, further including first and second auxiliary floor support legs connected with said central hub for additionally supporting said playpen on a surface.

8. A foldable playpen according to claim 1, wherein there are four said upper rails arranged in a substantially rectangular configuration.

9. A foldable playpen according to claim 1, wherein the length of said U-shaped connector is less than the lengths of said plates such that said plates permit upward pivotal movement of said rail sections relative to said plates.

10. A foldable playpen according to claim 1, wherein each said securing means includes release means for releasing the buttons from said pair of holes in said medial saddle member.

11. A foldable playpen according to claim 10, wherein said release means includes release slide means for sliding along said medial saddle member, said release slide means including projection means for pushing said buttons out of said holes in said medial saddle member when said release slide means is slid along said medial saddle member, retaining means on said medial saddle member for slidably retaining said release slide means thereon, and spring means for normally biasing said release slide means such that said projection means is positioned out of engagement with said buttons.

12. A foldable playpen according to claim 11, wherein said release slide means has a lower surface provided with two hemispherical recesses which are normally aligned with said pair of holes of said medial saddle member to receive said buttons therein and not interfere with the locking engagement by said buttons.

13. A foldable playpen comprising:

a) a frame including:

i) an upper frame assembly having a plurality of collapsible upper rails and securing means for releasably maintaining said upper fails in a non-collapsed position, each said upper rail including a first rail section and a second rail section, and said securing means including a plurality of securing elements, each securing element pivotally connecting adjacent ends of the rail sections of the same upper rail, and each said securing element includes a medial saddle member formed by two substantially rectangular plates and a central, inverted U-shaped connector which connects the upper edges of said plates together so as to maintain said plates in a parallel, spaced apart relation, with said adjacent ends of said rail sections being pivotally connected at opposite ends of said plates, one of said plates of each said medial saddle member including a pair of holes therein, and the adjacent ends of said rail sections each including a hole therein, a button extending through the hole therein and spring biasing means for biasing the button through the hole therein, such that engagement of each said button through one of said pair of holes in said medial saddle member results in releasable locking of said rail sections in said non-collapsed position.

14. A foldable playpen according to claim 13, wherein the length of said U-shaped connector is less than the lengths of said plates such that said plates permit upward pivotal movement of said rail sections relative to said plates.

15. A foldable playpen according to claim 13, wherein each said securing means includes release means for releasing the buttons from said pair of holes in said medial saddle member.

16. A foldable playpen according to claim 15, wherein said release means includes release slide means for sliding along said medial saddle member, said release slide means including projection means for pushing said buttons out of said holes in said medial saddle member when said release slide means is slid along said medial saddle member, retaining means on said medial saddle member for slidably retaining said release slide means thereon, and spring means for normally biasing said release slide means such that said projection means is positioned out of engagement with said buttons.

17. A foldable playpen according to claim 16, wherein said release slide means has a lower surface provided with two hemispherical recesses which are normally aligned with said pair of holes of said medial saddle member to receive said buttons therein and not interfere with the locking engagement by said buttons.

* * * * *